US006629340B1

(12) United States Patent
Dale et al.

(10) Patent No.: US 6,629,340 B1
(45) Date of Patent: Oct. 7, 2003

(54) ACOUSTIC UNDERLAYMENT FOR PRE-FINISHED LAMINATE FLOOR SYSTEM

(75) Inventors: Robert Dale, Lawrenceville, GA (US); James Schaeffer, Charleston, SC (US)

(73) Assignee: Polymer Group, Inc., North Charleston, SC (US)

( * ) Notice: Subject to any disclaimer, the term of this patent is extended or adjusted under 35 U.S.C. 154(b) by 0 days.

(21) Appl. No.: 10/117,243

(22) Filed: Apr. 5, 2002

(51) Int. Cl.[7] ..... D04H 1/46; D04H 5/02

(52) U.S. Cl. ..... 28/104; 28/106

(58) Field of Search ..... 28/104, 105, 163, 28/167, 106; 156/148, 176, 177, 181; 442/384, 387, 408

(56) References Cited

U.S. PATENT DOCUMENTS

| | | | | |
|---|---|---|---|---|
| 3,276,944 A | | 10/1966 | Levy | |
| 3,338,992 A | | 8/1967 | Kinney | |
| 3,341,394 A | | 9/1967 | Kinney | |
| 3,485,706 A | | 12/1969 | Evans | |
| 3,502,538 A | | 3/1970 | Petersen | |
| 3,502,763 A | | 3/1970 | Hartmann | |
| 3,509,009 A | | 4/1970 | Hartman | |
| 3,542,615 A | | 11/1970 | Dobo et al. | |
| 4,190,659 A | | 2/1980 | Hardtmann | |
| 4,636,419 A | | 1/1987 | Madsen et al. | |
| 5,098,764 A | | 3/1992 | Drelich et al. | |
| 5,136,761 A | * | 8/1992 | Sternlieb et al. | 28/104 |
| 5,144,729 A | | 9/1992 | Austin et al. | |
| 5,187,005 A | | 2/1993 | Stahle et al. | |
| 5,290,628 A | * | 3/1994 | Lim et al. | 442/408 |
| 5,475,903 A | | 12/1995 | Collins | |
| 5,618,610 A | * | 4/1997 | Tomita et al. | 428/152 |
| 5,657,520 A | * | 8/1997 | Greenway et al. | 26/51 |
| 5,678,379 A | | 10/1997 | Quattrociocchi | |
| 6,063,717 A | * | 5/2000 | Ishiyama et al. | 442/387 |
| 6,114,017 A | | 9/2000 | Fabbricante et al. | |
| 6,270,623 B1 | * | 8/2001 | Goda et al. | 162/114 |
| 6,306,234 B1 | * | 10/2001 | Barker et al. | 156/148 |
| 6,314,627 B1 | * | 11/2001 | Ngai | 28/104 |
| 6,381,817 B1 | * | 5/2002 | Moody, III | 28/104 |
| 6,460,233 B2 | * | 10/2002 | Noelle | 28/104 |
| 6,502,288 B2 | * | 1/2003 | Black et al. | 28/104 |
| 2002/0034914 A1 | * | 3/2002 | De Leon et al. | 442/384 |
| 2002/0100153 A1 | * | 8/2002 | Takai et al. | 28/104 |

FOREIGN PATENT DOCUMENTS

| | | |
|---|---|---|
| CA | 803714 | 1/1969 |

* cited by examiner

*Primary Examiner*—Amy B. Vanatta
(74) *Attorney, Agent, or Firm*—Wood, Phillips, Katz, Clark & Mortimer

(57) ABSTRACT

The present invention is directed to a method of forming a nonwoven fabric, which exhibits a pronounced durable three-dimensional image, permitting use of the fabric in floor underlayment of laminate floor systems so as to reduce acoustic feedback under normal use (walking) due to sound absorption and leveling of the floating laminate floor system applications. In particular, the present invention contemplates that a fabric is formed from a precursor web comprising at least one support layer or scrim, whereby when subjected to hydroentanglement on a moveable imaging surface of a three-dimensional image transfer device, an enhanced product is achieved. By formation in this fashion, hydroentanglement of the precursor web results in a more pronounced three-dimensional image, an image that is durable to abrasion and distortion.

11 Claims, 8 Drawing Sheets

"Dots"

ITD thickness: 0.25"
Thickness at Drainage: 0.15"
Nub Height: 0.08"

ACOUSTIC UNDERLAYMENT FOR PRE-FINISHED LAMINATE FLOOR SYSTEM

TECHNICAL FIELD

The present invention relates generally to methods of making nonwoven fabrics, and more particularly, to a method of manufacturing a nonwoven fabric exhibiting a durable three-dimensional image, permitting use of the fabric in floor underlayment of laminate floor systems so as to reduce acoustic feedback under normal use (walking) due to sound absorption and leveling of the floating laminate floor system applications.

BACKGROUND OF THE INVENTION

The production of conventional textile fabrics is known to be a complex, multi-step process. The production of fabrics from staple fibers begins with the carding process whereby the fibers ate opened and aligned into a feedstock referred to in the art as "sliver". Several strands of sliver are then drawn multiple times on a drawing frames to; further align the fibers, blend, improve uniformity and reduce the sliver's diameter. The drawn sliver is then fed into a roving frame to produce roving by further reducing its diameter as well as imparting a slight false twist. The roving is then fed into the spinning frame where it is spun into yarn. The yarns are next placed onto a winder where they are transferred into larger packages. The yarn is then ready to be used to create a fabric.

For a woven fabric, the yarns are designated for specific use as warp or fill yarns. The fill yarns (which run on the y-axis and are known as picks) are taken straight to the loom for weaving. The warp yarns (which run on the x-axis and are known as ends) must be further processed. The large packages of yarns are placed onto a warper frame and are wound onto a section beam were they are aligned parallel to each other. The section beam is then fed into a slasher where a size is applied to the yarns to make them stiffer and more abrasion resistant, which is required to withstand the weaving process. The yarns are wound onto a loom beam as they exit the slasher, which is then mounted onto the back of the loom. The warp yarns are threaded through the needles of the loom, which raises and lowers the individual yarns as the filling yarns are interested perpendicular in an interlacing pattern thus weaving the yarns into a fabric. Once the fabric has been woven, it is necessary for it to go through a scouring process to remove the size from the warp yarns before it can be dyed or finished. Currently, commercial high-speed looms operate at a speed of 1000 to 1500 picks per minute, where a pick is the insertion of the filling yarn across the entire width of the fabric. Sheeting and bedding fabrics are typically counts of 80×80 to 200×200, being the ends per inch and picks per inch, respectively. The speed of weaving is determined by how quickly the filling yarns are interlaced into the warp yarns, therefore looms creating bedding fabrics are generally capable of production speeds of 5 inches to 18.75 inches per minute.

In contrast, the production of nonwoven fabrics from staple fibers is known to be more efficient than traditional textile processes, as the fabrics are produced directly from the carding process.

Nonwoven fabrics are suitable for use in a wide variety of applications where the efficiency with which the fabrics can be manufactured provides a significant economic advantage for these fabrics versus traditional textiles. However, nonwoven fabrics have commonly been disadvantaged when fabric properties are compared to conventional textiles, particularly in terms of resistance to elongation, in applications where both transverse and co-linear stresses are encountered. Hydroentangled fabrics have been developed with improved properties, by the formation of complex composite structures in order to provide a necessary level of fabric integrity. Subsequent to entanglement, fabric durability has been further enhanced by the application of binder compositions and/or by thermal stabilization of the entangled fibrous matrix.

Nonwoven composite structures typically improve physical properties, such as elongation, by way of incorporation of a support layer or scrim. The support layer material can comprise an array of polymers, such as polyolefins, polyesters, polyurethanes, polyamides, and combinations thereof, and take the form of a film, fibrous sheeting, or grid-like meshes. Metal screens, fiberglass, and vegetable fibers are also utilized as support layers. The support layer is commonly incorporated either by mechanical or chemical means to provide reinforcement to the composite fabric. Reinforcement layers, also referred to as a "scrim" material, are described in detail in U.S. Pat. No. 4,636,419, which is hereby incorporated by reference. The use of scrim material, more particularly, a spunbond scrim material is known to those skilled in the art.

Spunbond material comprises continuous filaments typically formed by extrusion of thermoplastic resins through a spinneret assembly, creating a plurality of continuous thermoplastic filaments. The filaments are then quenched and drawn, and collected to form a nonwoven web. Spunbond materials have relatively high resistance to elongation and perform well as a reinforcing layer or scrim. U.S. Pat. No. 3,485,706 to Evans, et al., which is hereby incorporated by reference, discloses a continuous filament web with an initial random staple fiber batt mechanically attached via hydroentanglement, with a second random staple fiber batt then attached to the continuous filament web, again, by hydroentanglement. A continuous filament web is also utilized in U.S. Pat. Nos. 5,144,729; 5,187,005; and 4,190,695. These patents include a continuous filament web for reinforcement purposes or to reduce elongation properties of the composite.

More recently, hydroentanglement techniques have been developed which impart images or patterns to the entangled fabric by effecting hydroentanglement on three-dimensional image transfer devices. Such three-dimensional image transfer devices are disclosed in U.S. Pat. No. 5,098,764, which is hereby incorporated by reference, with the use of such image transfer devices being desirable for providing a fabric with enhanced physical properties as well as functional dimension.

A three-dimensionally imaged nonwoven fabric must exhibit a combination of specific physical characteristics so as to be beneficial in application as a floor underlayment. For example, when such fabrics are used in flooring underlayment, the fabric must exhibit sufficient durability to withstand application upon abrasive surfaces and yet exhibit a pronounced and resilient three-dimensional pattern so as to provide proper leveling of the floating laminate floor system. Further, three-dimensionally imaged nonwoven fabrics used in industrial applications require sufficient resistance to elongation so as to resist deformation of the image when the fabric is converted into a final end-use article and when used in the final application.

Notwithstanding various attempts in the prior art to develop an acoustic underlayment for pre-finished laminate floor systems, a need continues to exist for a nonwoven fabric, which provides a pronounced image for leveling purposes, as well as sound absorption to reduce acoustic feedback.

SUMMARY OF THE INVENTION

The present invention is directed to a method of forming a nonwoven fabric, which exhibits a pronounced durable three-dimensional image, permitting use of the fabric in floor underlayment of laminate floor systems so as to reduce acoustic feedback under normal use (walking) due to sound absorption and leveling of the floating laminate floor system applications. In particular, the present invention contemplates that a fabric is formed from a precursor web comprising at least one support layer or scrim, whereby when subjected to hydroentanglement on a moveable imaging surface of a three-dimensional image transfer device, an enhanced product is achieved. By formation in this fashion, hydroentanglement of the precursor web results in a more pronounced three-dimensional image, an image that is durable to abrasion and distortion.

In accordance with the present invention, a method of making a nonwoven fabric embodying the present invention includes the steps of providing a precursor web comprising a fibrous matrix. While use of staple length fibers is typical, the fibrous matrix may comprise substantially continuous filaments. In a particularly preferred form, the fibrous matrix comprises staple length fibers, which are carded and cross-lapped to form a precursor web. In one embodiment of the present invention, the precursor web is subjected to pre-entangling on a foraminous-forming surface prior to juxtaposition of a support layer or scrim and subsequent three-dimensional imaging. Alternately, one or more layers of fibrous matrix are juxtaposed with one or more support layers or scrims, then the layered construct is pre-entangled to form a precursor web which is imaged directly, or subjected to further fiber, filament, support layers, or scrim layers prior to imaging.

The present method further contemplates the provision of a three-dimensional image transfer device having a movable imaging surface. In a typical configuration, the image transfer device may comprise a drum-like apparatus, which is rotatable with respect to one or more hydroentangling manifolds.

The precursor web is advanced onto the imaging surface of the image transfer device. Hydroentanglement of the precursor web is effected to form a three-dimensionally imaged fabric. Significantly, the incorporation of at least one support layer or scrim acts to focus the fabric tension therein, allowing for improved imaging of the staple fiber layer or layers, and resulting in a more pronounced three-dimensional image.

Subsequent to hydroentanglement, the three-dimensionally imaged fabric may be subjected to one or more variety of post-entanglement treatments. Such treatments may include application of a polymeric binder composition, mechanical compacting, application of additives or electrostatic compositions, and like processes.

A further aspect of the present invention is directed to a method of forming a durable nonwoven fabric, which exhibits a pronounced and resilient three-dimensionality, while providing the necessary resistance to abrasion and distortion, to facilitate use in a wide variety of industrial applications. The fabric exhibits a high degree of fiber retention, thus permitting its use in those applications in which the fabric is used as an underlayment for various floating floor systems. Further, the support layer or scrim aids in preventing the distortion of the imprinted image upon the application of tension to the composite fabric during routine processing and use.

A method of making the present durable nonwoven fabric comprises the steps of providing a precursor web, which is subjected to hydroentangling. The precursor web is formed into a three-dimensionally imaged nonwoven fabric by hydroentanglement on a three-dimensional image transfer device. The image transfer device defines three-dimensional elements against which the precursor web is forced during hydroentanglement, whereby the fibrous constituents of the web are imaged by movement into regions between the three-dimensional elements and surface asperities of the image transfer device. In the preferred form, the precursor web is hydroentangled on a foraminous surface prior to hydroentangling on the image transfer device. This pre-entangling of the precursor web acts to integrate the fibrous components of the web, but does not impart a three-dimensional image as can be achieved through the use of the three-dimensional image transfer device.

Optionally, subsequent to three-dimensional imaging, the imaged nonwoven fabric can be treated with a performance or aesthetic modifying composition to further alter the fabric structure or to meet end-use article requirements. A polymeric binder composition can be selected to enhance durability characteristics of the fabric or an antimicrobial additive may be used utilized to deter the growth of fungus and mold.

Other features and advantages of the present invention will become readily apparent from the following detailed description, the accompanying drawings, and the appended claims.

DETAILED DESCRIPTION

Figure 1:
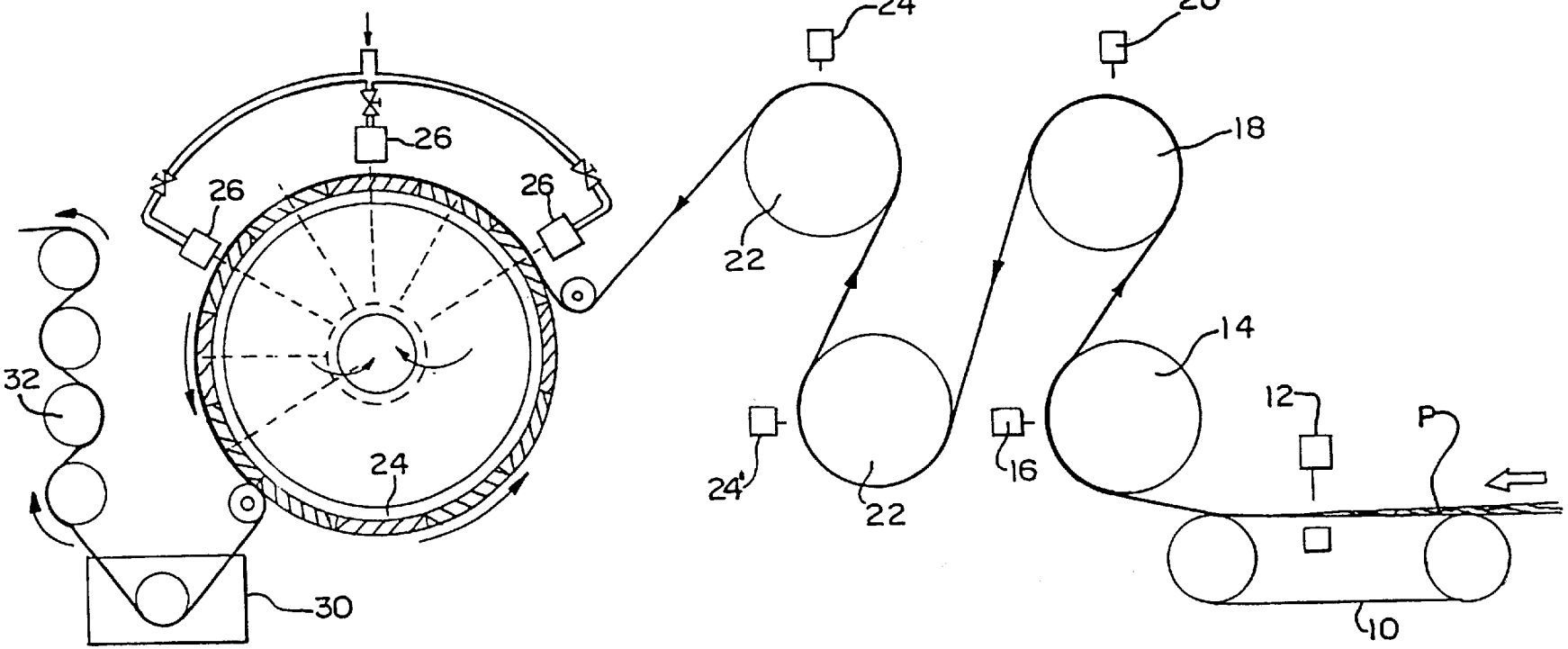
FIG. 1 is a diagrammatic view of an apparatus for manufacturing a durable nonwoven fabric, embodying the principles of the present invention.

While the present invention is susceptible of embodiment in various forms, there is shown in the drawings, and will hereinafter be described, a presently preferred embodiment of the invention, with the understanding that the present disclosure is to be considered as an exemplification of the invention, and is not intended to limit the invention to the specific embodiment illustrated. The present invention is directed to a method of forming a durable three-dimensionally imaged nonwoven suitable for use as acoustic underlayment for pre-finished laminate floor systems wherein the three-dimensional imaging of the fabrics is enhanced by the incorporation of at least one support layer or scrim. Enhanced imaging can be achieved utilizing various techniques. One such technique involves minimizing and eliminating tension in the overall precursor web as the web is advanced onto a moveable imaging surface of the image transfer device, as represented by co-pending U.S. patent application, Ser. No. 60/344,259 to Putnam et al., entitled Nonwoven Fabrics Having a Durable Three-Dimensional Image, and filed on Dec. 28, 2002, which is hereby incorporated by reference. By use of a support layer or scrim, enhanced fiber entanglement is achieved, with the physical properties, both aesthetic and mechanical, of the resultant fabric being desirably enhanced. It is reasonably believed that the internal support of the precursor web provided by the support layer or scrim, as the precursor web is advanced onto the image transfer device, desirably acts to focus tension to the support layer or scrim. Without tension, the fibers or filaments of the fibrous matrix, from which the precursor web is formed, can more easily move and shift during hydroentanglement, thus resulting in improved three-dimensional imaging on the image transfer device. A more clearly defined and durable image is achieved.

With reference to FIG. 1 therein is illustrated an apparatus for practicing the present method for forming a nonwoven fabric. The fabric is formed from a fibrous matrix, which typically comprises staple length fibers, but may comprise substantially continuous filaments. The fibrous matrix is preferably carded and cross-lapped to form a fibrous batt, designated F. In a current embodiment, the fibrous batt comprises 100% cross-lap fibers, that is, all of the fibers of the web have been formed by cross-lapping a carded web so that the fibers are oriented at an angle relative to the machine direction of the resultant web. U.S. Pat. No. 5,475,903, hereby incorporated by reference, illustrates a web drafting apparatus.

A support layer or scrim is then placed in face to face juxtaposition with the fibrous web and hydroentangled to form precursor web P. Alternately, the fibrous web can be hydroentangled first to form precursor web P, and subsequently, at least one support layer or scrim is applied to the precursor web, and the composite construct optionally further entangled with non-imaging hydraulic manifolds, then imparted with a three-dimensional image on an image transfer device.

FIG. 1 illustrates a hydroentangling apparatus for forming nonwoven fabrics in accordance with the present invention. The apparatus includes a foraminous-forming surface in the form of belt 10 upon which the precursor web P is positioned for pre-entangling by entangling manifold 12. Pre-entangling of the precursor web, prior to three-dimensional imaging, is subsequently effected by movement of the web P sequentially over a drum 14 having a foraminous-forming surface, with entangling manifold 16 effecting entanglement of the web. Further entanglement of the web is effected on the foraminous forming surface of a drum 18 by entanglement manifold 20, with the web subsequently passed over successive foraminous drums 20, for successive entangling treatment by entangling manifolds 24, 24'.

The entangling apparatus of FIG. 1 further includes a three-dimensional imaging drum 24 comprising a three-dimensional image transfer device for effecting imaging of the now-entangled precursor web. The image transfer device includes a moveable imaging surface which moves relative to a plurality of entangling manifolds 26 which act in cooperation with three-dimensional elements defined by the imaging surface of the image transfer device to effect imaging and patterning of the fabric being formed.

The present invention contemplates that the support layer or scrim be any such suitable material, including, but not limited to, wovens, knits, open mesh scrims, and/or nonwoven fabrics, which exhibit low elongation performance. Two particular nonwoven fabrics of particular benefit are spunbond fabrics, as represented by U.S. Pat. Nos. 3,338,992; 3,341,394; 3,276,944; 3,502,538; 3,502,763; 3,509,009; 3,542,615; and Canadian Patent No. 803,714, these patents are incorporated by reference, and nanofiber fabrics as represented by U.S. Pat. Nos. 5,678,379 and 6,114,017, both incorporated herein by reference. A particularly preferred embodiment of support layer or scrim is a thermoplastic spunbond nonwoven fabric. The support layer may be maintained in a wound roll form, which is then continuously fed into the formation of the precursor web, and/or supplied by a direct spinning beam located in advance of the three-dimensional imaging drum 24.

Manufacture of a durable nonwoven fabric embodying the principles of the present invention is initiated by providing the fibrous matrix, which can include the use of staple length fibers, continuous filaments, and the blends of fibers and/or filaments having the same or different composition. Fibers and/or filaments are selected from natural or synthetic composition, of homogeneous or mixed fiber length. Suitable natural fibers include, but are not limited to, cotton, wood pulp and viscose rayon. Synthetic fibers, which may be blended in whole or part, include thermoplastic and thermoset polymers. Thermoplastic polymers suitable for blending with dispersant thermoplastic resins include polyolefins, polyamides and polyesters. The thermoplastic polymers may be further selected from homopolymers; copolymers, conjugates and other derivatives including those thermoplastic polymers having incorporated melt additives or surface-active agents. Staple lengths are selected in the range of 0.25 inch to 10 inches, the range of 1 to 3 inches being preferred and the fiber denier selected in the range of 1 to 22, the range of 1.2 to 6 denier being preferred for general applications. The profile of the fiber and/or filament is not a limitation to the applicability of the present invention.

EXAMPLES

Comparative Example 1

Using a forming apparatus as illustrated in FIG. 1, a nonwoven fabric was made by providing a precursor web comprising 100 weight percent polyester fibers. The web had a basis weight of 3 ounces per square yard (plus or minus 7%). The precursor web was 100% carded and cross-lapped, with a draft ratio of 2.5 to 1.

Prior to three-dimensional imaging of the precursor web, the web was entangled by a series of entangling manifolds such as diagrammatically illustrated in FIG. 1. FIG. 1 illustrates disposition of precursor web P on a foraminous forming surface in the form of belt 10, with the web acted upon by an entangling manifold 12. The web then passes sequentially over a drum 14 having a foraminous forming surface,for entangling by entangling manifold 16, with the web thereafter directed about the foraminous forming surface of a drum 18 for entangling by entanglement manifold 20. The web is thereafter passed over successive foraminous drums 22, with successive entangling treatment by entangling manifolds 24', 24'. In the present examples, each of the entangling manifolds included 120 micron orifices spaced at 42.3 per inch, with the manifolds successively operated at 100, 300, 700, and 1300 pounds per square inch, with a line speed of 45 yards per minute. A web having a width of 72 inches was employed.

The entangling apparatus of FIG. 1 further includes a three-dimensional imaging drum 24 comprising a three-dimensional image transfer device for effecting imaging and patterning of the now-entangled precursor web. The entangling apparatus includes a plurality of entangling manifolds 26, which act in cooperation with the three-dimensional image transfer device of drum 24 to effect patterning of the fabric. In the present example, the imaging manifolds 26 were successively operated at 2800, 2800, and 2800 pounds per square inch, at a line speed which was the same as that used during pre-entanglement. A performance or aesthetic modifying composition can optionally be applied to the imaged fabric at 30, with the fabric then dried on drying cans 32.

Figure 2:
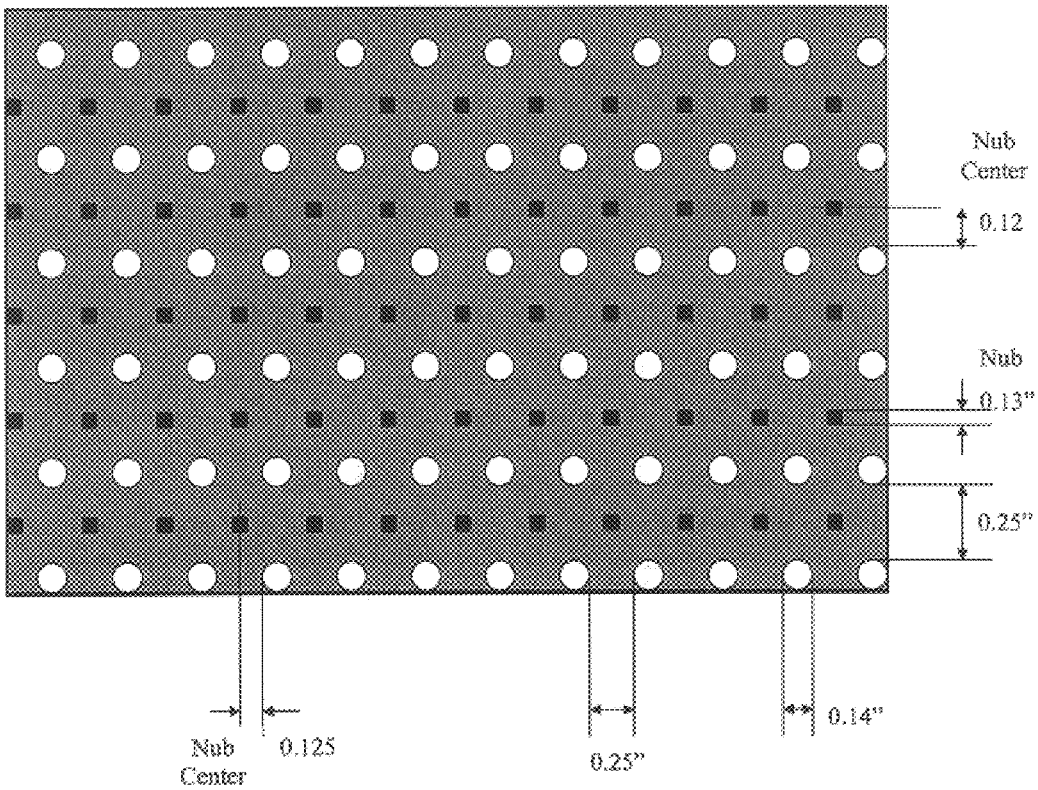
FIG. 2 is a plan view of a three-dimensional image transfer device of the type, referred to as "node", used for practicing the present invention, with approximate dimension as shown.

The three-dimensional image transfer device of drum 24 was configured as a so-called "node" image, as illustrated in FIG. 2.

Figure 3:
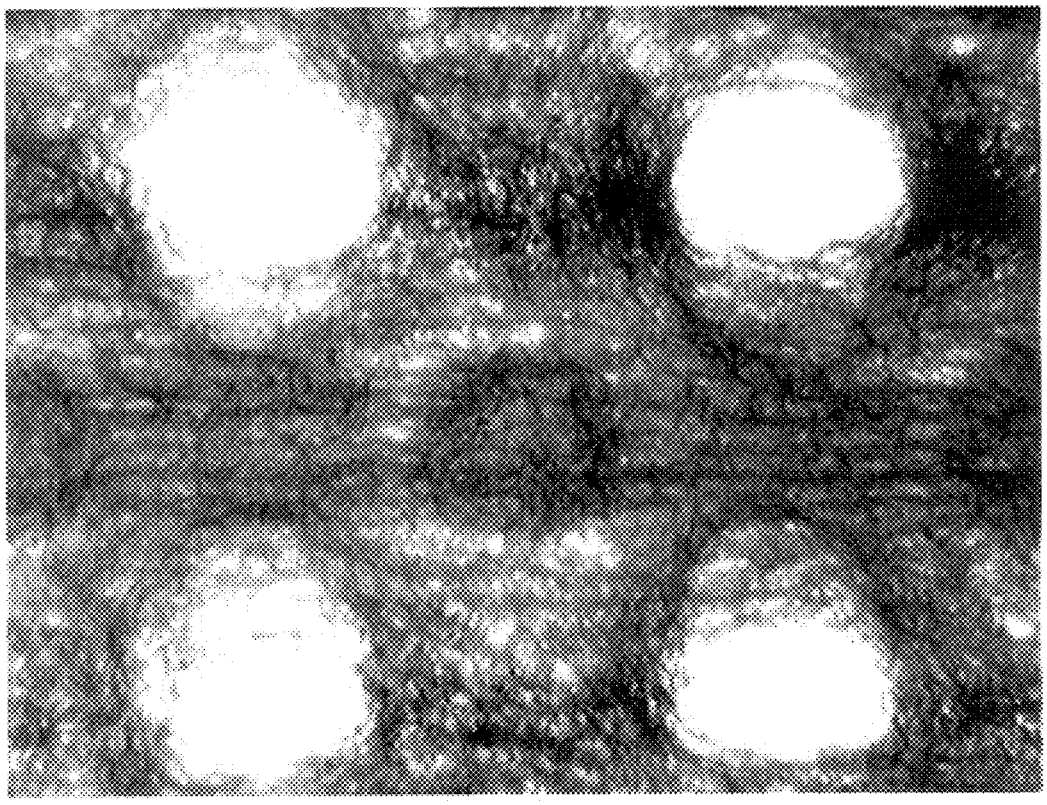
FIG. 3 is a top plan photomicrograph of an nonwoven fabric having been imaged using the "node" image transfer device of FIG. 2, produced from a fibrous matrix alone utilizing a backlit light source, the magnification is approximately 10×.
Figure 5:
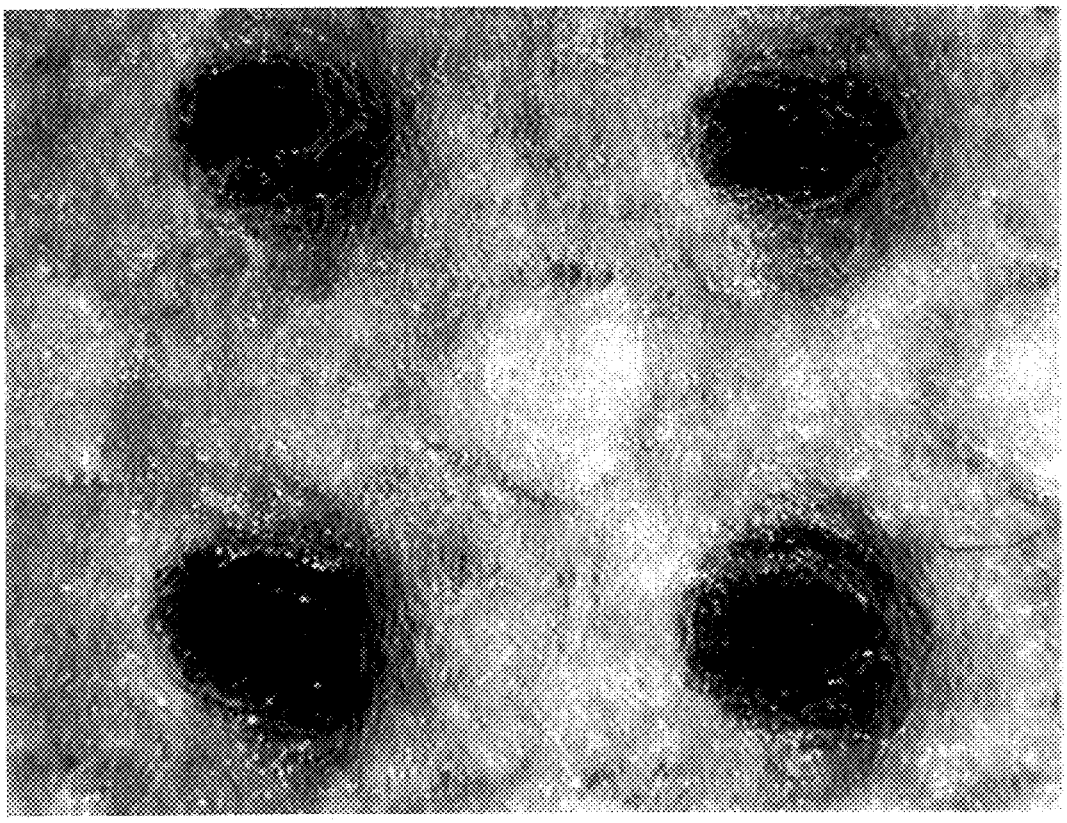
FIG. 5 is top plan photomicrograph of the same fabric as in FIG. 3, wherein a top-lit light source at an incident angle of 45 degrees was used, the magnification is approximately 10×.
Figure 7:
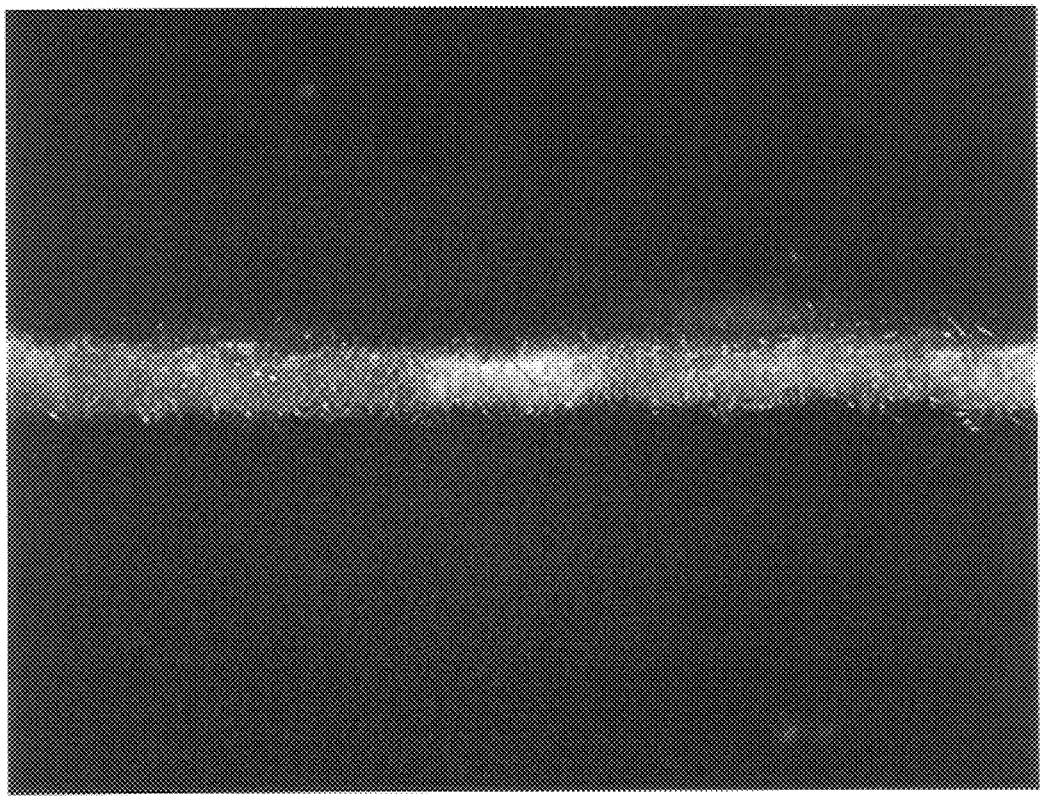
FIG. 7 is a side photomicrograph of the same fabric as in FIG. 3, wherein a top-lit light source at an incident angle of about 90 degrees was used, the magnification is approximately 10×.

Images of the comparative material are presented in FIGS. 3, 5, and 7.

Example 1

A three-dimensionally imaged nonwoven fabric was manufactured by a process as described in Comparative Example 1, wherein in the alternative, and in accordance with the present invention, a lighter 1.5 ounce per square yard polyester staple fiber web was juxtaposed with a 1.5 ounce polyester spunbond web of approximately 2.0 denier. The staple fiber web/spunbond web layered matrix was then subjected to equivalent hydraulic pressures as described in Comparative Example 1.

Figure 4:
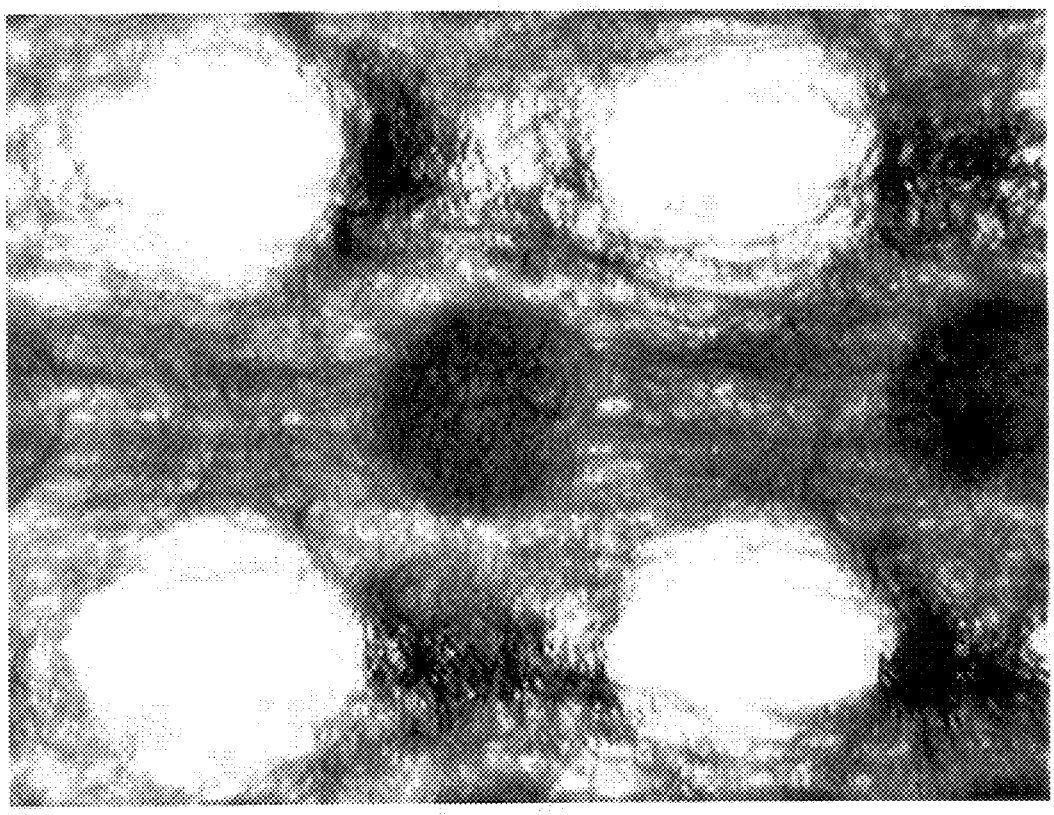
FIG. 4 is a top plan photomicrograph of a nonwoven fabric having been imaged using the "node" image transfer device of FIG. 2, produced in accordance with the present invention, the magnification is approximately 10×.
Figure 6:
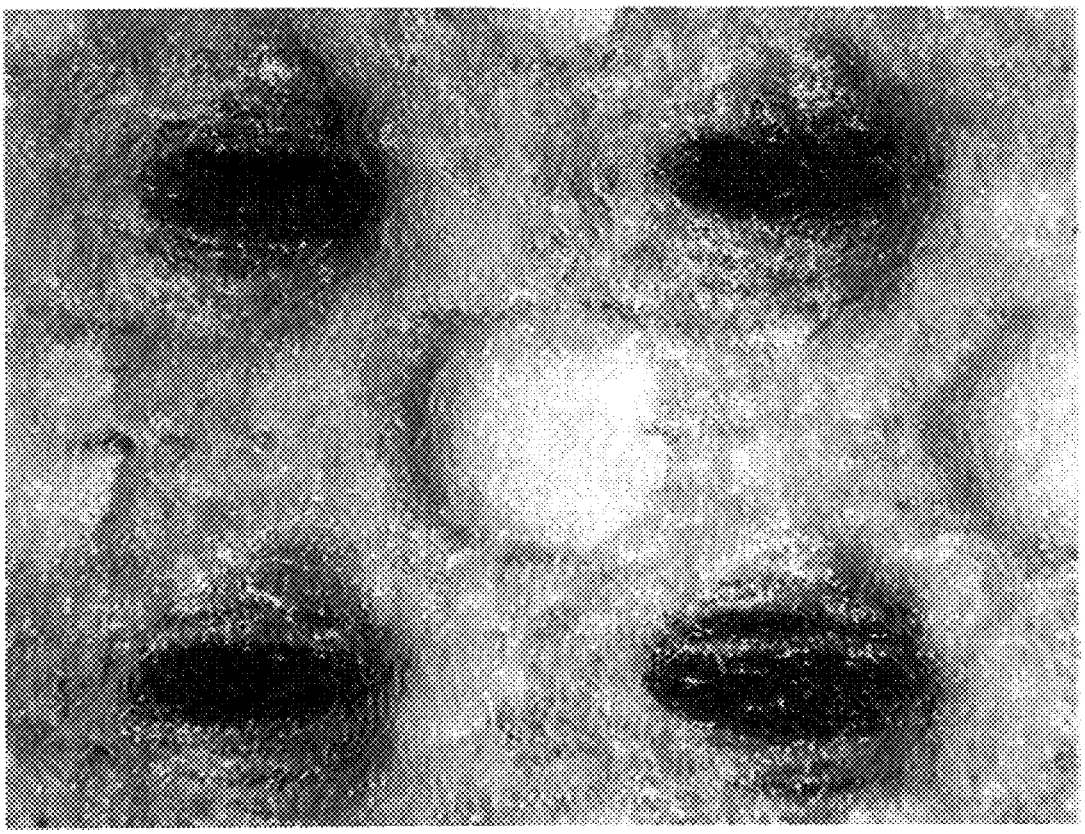
FIG. 6 is a top plan photomicrograph of the same fabric as in FIG. 4, wherein a top-lit light source at an incident angle of 45 degrees was used, the magnification is approximately 10×.
Figure 8:
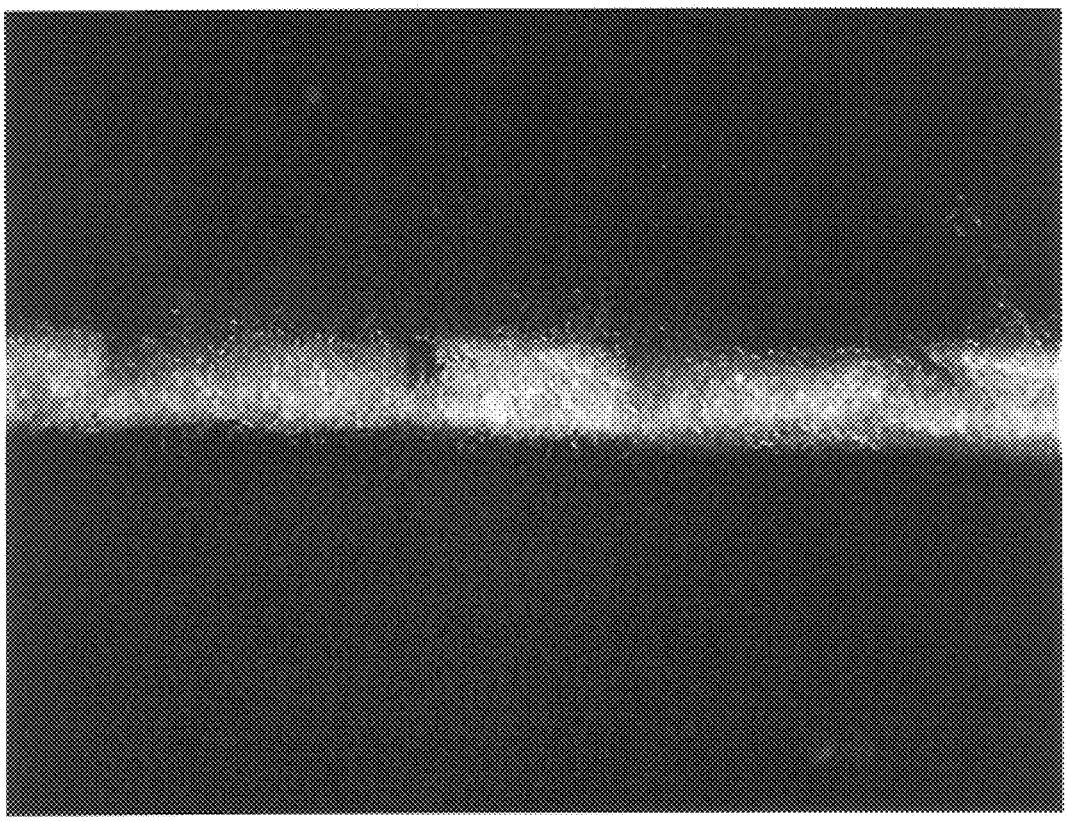
FIG. 8 is a side photomicrograph of the same fabric as in FIG. 4, wherein a top-lit light source at an incident angle of about 90 degrees was used, the magnification is approximately 10×.

Images of the improved material of the present invention are presented in FIGS. 4, 6 and 8.

With reference to FIGS. 3 through 8, it is apparent that the imaged nonwoven fabrics made in accordance with the present invention exhibit greater three-dimensional image clarity and are more pronounced than the image imparted to equivalent basis weight materials without the support layer or scrim. The more pronounced three-dimensional images further result in increased bulk, as is depicted in the comparison of FIG. 7 and FIG. 8. Imaged nonwoven fabrics, such as Example 1, further exhibit a significantly reduced performance, resulting in improved image retention during mechanical processing and use.

The material of the present invention may be utilized as a sound absorbent underlayment as well as provide for leveling of various floor systems, including floating laminate floor systems, and other end use products where a three-dimensionally imaged nonwoven fabric can be employed. Other end uses include; fabrication into acoustic wall systems, automotive applications, wet or dry hard surface wipes, which can be readily hand-held for cleaning and the like, protective wear for industrial uses, such as gowns or smocks, shirts, bottom weights, lab coats, face masks, and the like, and protective covers, including covers for vehicles such as cars, trucks, boats, airplanes, motorcycles, bicycles, golf carts, as well as covers for equipment often left outdoors like grills, yard and garden equipment, such as mowers and roto-tillers, lawn furniture, floor coverings, table cloths and picnic area covers.

From the foregoing, it will be observed that numerous modifications and variations can be affected without departing from the true spirit and scope of the novel concept of the present invention. It is to be understood that no limitation with respect to the specific embodiments illustrated herein is intended or should be inferred. The disclosure is intended to cover, by the appended claims, all such modifications as fall within the scope of the claims.

What is claimed is:

1. A method of making an imaged nonwoven fabric, comprising the steps of:

providing a fibrous matrix;

providing a self-supporting support layer;

providing a three-dimensional image transfer device having a movable imaging surface, said imaging surface of said image transfer device defining a network of discrete nubs each surrounded completely by a support surface, and discrete drainage openings extending into said support surface;

juxtaposing said fibrous matrix and said support layer and applying hydraulic energy to entangle said fibrous matrix and said support layer into a precursor web;

advancing said precursor web onto said image transfer device so that said web moves with said imaging surface, including minimizing tension to which said fibrous matrix is subjected during said advancing step by supporting said fibrous matrix with said support layer; and hydroentangling said precursor web on said image transfer device to form a three-dimensionally imaged nonwoven fabric, wherein said fabric includes a plurality of discrete, upstanding nodes, and a plurality of apertures.

2. A method of making an imaged nonwoven fabric in accordance with claim 1, wherein:

said fibrous matrix comprises staple length fibers.

3. A method of making an imaged nonwoven fabric in accordance with claim 1, wherein:

said fibrous matrix comprises substantially continuous filaments.

4. A method of making an imaged nonwoven fabric in accordance with claim 1, wherein:

said support layer is a scrim.

5. A method of making an imaged nonwoven fabric in accordance with claim 1, wherein:

said support layer is selected from the group consisting of wovens, knits, open grid meshes, and nonwoven fabrics.

6. A method of making an imaged nonwoven fabric in accordance with claim 1, wherein:

said imaged nonwoven fabric is an acoustic underlayment for pre-finished laminate flooring systems.

7. A method of making an imaged nonwoven fabric in accordance with claim 1, wherein:

said discrete drainage openings are arranged in rows.

8. A method of making an imaged nonwoven fabric in accordance with claim 7, wherein:

said discrete nubs are arranged in rows.

9. A method of forming an imaged nonwoven fabric in accordance with claim 8, wherein:

said rows of nubs alternate with said rows of openings.

10. A method of forming an imaged nonwoven fabric in accordance with claim 9, wherein:

said nubs of one of said rows are staggered with respect to the openings of an adjacent one of said rows of openings.

11. A method of making a nonwoven fabric, comprising the steps of:

providing a fibrous matrix;

providing a self-supporting support layer;

carding said fibrous matrix;

cross-lapping said fibrous matrix to form a precursor web;

entangling said precursor web on a foraminous forming surface;

juxtaposing said support layer onto said precursor web;

providing a three-dimensional image transfer device comprising an imaging surface having an array of three-dimensional surface elements, said imaging surface being movable relative to at least one associated hydroentangling manifold, said imaging surface of said image transfer device defining a network of discrete nubs each surrounded completely by a support surface, and discrete drainage openings extending into said support surface; and advancing said juxtaposed precursor web and said support layer onto said image transfer device, including minimizing the tension to which said fibrous matrix is subjected during said advancing step by supporting said fibrous matrix with said support layer;

hydroentangling said precursor web on said imaging surface so that portions of said precursor web are displaced from on top of said three-dimensional surface elements to form an imaged and patterned nonwoven fabric, wherein said fabric includes a plurality of discrete, upstanding nodes, and a plurality of apertures.

* * * * *